US010933454B2

(12) United States Patent
Robbins

(10) Patent No.: US 10,933,454 B2
(45) Date of Patent: Mar. 2, 2021

(54) EXTRUSION PRESS CONTAINER AND LINER FOR SAME, AND METHOD

(71) Applicant: Exco Technologies Limited, Markham (CA)

(72) Inventor: Paul H. Robbins, Markham (CA)

(73) Assignee: Exco Technologies Limited, Markham (CA)

( * ) Notice: Subject to any disclaimer, the term of this patent is extended or adjusted under 35 U.S.C. 154(b) by 186 days.

(21) Appl. No.: 16/153,477

(22) Filed: Oct. 5, 2018

(65) Prior Publication Data

US 2020/0108430 A1 Apr. 9, 2020

(51) Int. Cl.

*B21C 27/00* (2006.01)
*B21C 23/21* (2006.01)
*B21C 29/00* (2006.01)

(52) U.S. Cl.

CPC ..... *B21C 23/212* (2013.01); *B21C 27/00* (2013.01); *B21C 29/006* (2013.01)

(58) Field of Classification Search

CPC ..... B21C 23/04; B21C 23/212; B21C 23/215; B21C 27/00; B21C 27/04; B21C 29/006; B21C 29/02

See application file for complete search history.

(56) References Cited

U.S. PATENT DOCUMENTS 3,164,253 A * 1/1965 Muller ..... B21C 27/04 72/20.2
4,028,795 A * 6/1977 Takahashi ..... C22C 1/0416 29/403.2
4,117,703 A * 10/1978 Takahashi ..... B21C 23/002 29/403.2
4,165,625 A * 8/1979 Wagner ..... B21C 23/00 72/38
5,896,772 A * 4/1999 Izumi ..... B21C 26/00 72/272
6,637,250 B2 * 10/2003 Plata ..... B21C 23/00 72/272
2011/0296889 A1 * 12/2011 Yamamoto ..... B21C 27/04 72/253.1
2015/0352614 A1 * 12/2015 Yamamoto ..... B21C 23/212 72/272

FOREIGN PATENT DOCUMENTS

DE 1058460 B * 6/1959 ..... B21C 27/04
FR 2400973 A1 * 3/1979 ..... B21C 27/04

* cited by examiner

*Primary Examiner* — Edward T Tolan

(57) ABSTRACT

A container for use in a metal extrusion press comprises: a mantle having an elongate body comprising an axial bore; an elongate liner accommodated within the axial bore. The liner comprises a longitudinally extending passage through which a billet is advanced, and an elongate slot adjoining the passage. The container also comprises a vacuum conduit in fluid communication with the passage for removal of gases from the passage during extrusion.

17 Claims, 9 Drawing Sheets

EXTRUSION PRESS CONTAINER AND LINER FOR SAME, AND METHOD

FIELD OF THE INVENTION

The present invention relates generally to extrusion and in particular, to an extrusion press container and a liner for same, and a method.

BACKGROUND OF THE INVENTION

Metal extrusion presses are well known in the art, and are used for forming extruded metal products having cross-sectional shapes that generally conform to the shape of the extrusion dies used. A typical metal extrusion press comprises a generally cylindrical container having an outer mantle and an inner tubular liner. The container serves as a temperature controlled enclosure for a billet during extrusion. An extrusion ram is positioned adjacent one end of the container. The end of the extrusion ram abuts a dummy block, which in turn abuts the billet allowing the billet to be advanced through the container. An extrusion die is positioned adjacent the opposite end of the container.

During operation, once the billet is heated to a desired extrusion temperature (typically 800-900° F. for aluminum), it is delivered to the extrusion press. The extrusion ram is then activated to abut the dummy block thereby advancing the billet into the container and towards the extrusion die. Under the pressure exerted by the advancing extrusion ram and dummy block, the billet is extruded through the profile provided in the extrusion die until all or most of the billet material is pushed out of the container, resulting in the extruded product.

During extrusion, gases can become trapped between the billet and the container wall. If not removed, these gases can become incorporated into the billet and form voids or air bubbles in the extruded product, commonly known as "blistering". To reduce or eliminate the occurrence of blistering, the container can be vented to allow pressurized gases to escape before they become trapped in the extruded product.

Gas removal during metal extrusion has been described. For example, U.S. Pat. No. 2,753,995 to Tennant et al. describes a billet press for extruding metal from a succession of billets comprising at least one cylinder open at one end to receive a ram and leading at its other end to an extrusion orifice, a ram, means for forcing the ram into the cylinder, a straight passage extending through the wall of the cylinder opening into the cylinder through an orifice of small diameter near the region occupied by the end of a new billet adjacent the ram head when the new billet is in position in contact with the residue of the old charge, and adapted to receive means for clearing the passage, and means connected to the passage for producing a vacuum.

U.S. Pat. No. 4,033,024 to Takahashi et al. describes a method for producing extruded structural profiles from aluminum or aluminum alloy scrap materials. The scrap materials are compacted under room temperature or under heat suitable for hot extrusion into a cylindrical body which is of such a dimension that is suitable for insertion into an extruder. The compacted body has an average density that is 70 to 86 percent of that of aluminum, and includes longitudinal air passages. During extrusion, suction pressure is applied to the interior of the extruder to remove air entrapped in the body.

U.S. Pat. No. 5,054,303 to Newman describes an extrusion press having a void space between a pressure pad, a billet container, an extrusion die and the billet to be extruded, which is evacuated by suction through the pressure pad and a hollow extrusion stem before commencement of extrusion. The extrusion ram is hollow and contains a vacuum reservoir connected to the hollow stem by a vacuum line and a valve.

U.S. Pat. No. 5,311,761 to Robbins describes an extrusion press for extruding extrudable metals through a die by use of a dummy block, and including a mechanical venting device to vent gases from the container. The venting device has: i) a circular shaped valve member provided in a front face of the dummy block, the valve member being moveable inwardly and outwardly of the dummy block from an open venting position to a closed position; ii) a channel provided in the dummy block and leading away therefrom to vent gases away from the valve in the open position; and iii) a spring for biasing the valve member to the open position. The spring resists movement of the valve member toward the closed position by virtue of the dummy block moving into the container and the valve member contacts a metal billet in the container and is thereby urged toward the closed position. The spring has a present resistance value which resists movement of the valve member to the closed position at least until a metal billet in the container commences to upset and flow within the container at which moment force on the valve member due to the dummy block advancing into the container exceeds the resistance value of the biasing means. In this manner, the valve is retained in the open position until the last possible moment to vent gases from the container.

U.S. Pat. No. 5,392,628 to Cristiani describes an extrusion press having a sealing and suction device mounted around a plunger with the possibility of sliding axially along the same. The device creates an airtight seal against a back face of a container for a billet when the plunger is working within an inner chamber of the container. A vacuum is created inside the chamber as soon as the plunger enters the chamber before extrusion of the billet begins.

Improvements are generally desired. It is therefore an object at least to provide a novel extrusion press container and a liner for same, and a method.

SUMMARY OF THE INVENTION

In one aspect, there is provided a container for use in a metal extrusion press, the container comprising: a mantle having an elongate body comprising an axial bore; an elongate liner accommodated within the axial bore, the liner comprising: a longitudinally extending passage through which a billet is advanced, and an elongate slot adjoining the passage; and a vacuum conduit in fluid communication with the passage for removal of gases from the passage during extrusion.

The slot may extend partially the length of the liner. The slot may extend from an end of the liner. The slot may extend in a direction parallel to a longitudinal axis of the passage.

The slot may adjoin the passage along a full length of the slot. The slot may be located at the top of the passage.

The slot may have a width that extends around only a portion of the circumference of the passage. The width of the slot may subtend an angle at the center of the passage. The angle may be between about 5 degrees to about 25 degrees.

The slot may have a depth that is less than a wall thickness of the liner.

The vacuum conduit may be in fluid communication with a vacuum source. The vacuum source may be a vacuum pump.

The mantle may further comprise a plurality of longitudinal bores, each of the bores accommodating a respective heating element.

The mantle may be configured for connecting to an extrusion press.

In another aspect, there is provided a liner for use with a container for use in a metal extrusion press, the liner comprising: a longitudinally extending passage through which a billet is advanced, and an elongate slot adjoining the passage, the slot being sized to be in fluid communication with a vacuum conduit for removal of gases from the passage during extrusion.

In another aspect, there is provided a method of operating a metal extrusion press having an extrusion container, the method comprising: delivering a heated billet to the container; advancing the billet into the container and through an extrusion die using an extrusion ram; and applying suction to the container during said delivering and said advancing.

The suction may be continuously applied without forming a seal around the billet.

BRIEF DESCRIPTION OF THE DRAWINGS

Embodiments will now be described more fully with reference to the accompanying drawings in which.

DETAILED DESCRIPTION OF THE EMBODIMENTS

Figure 1:
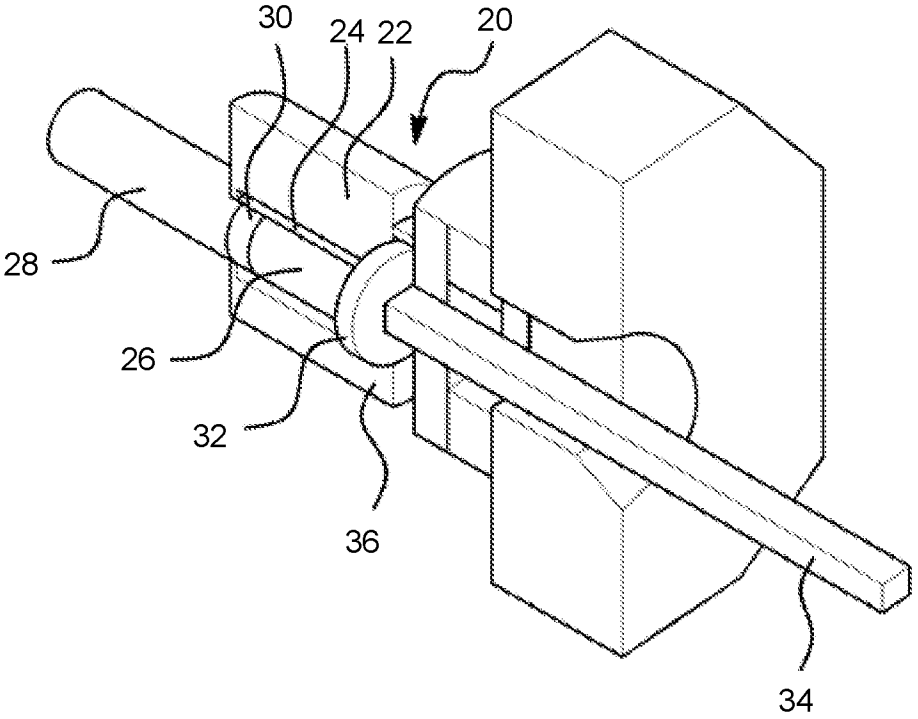
FIG. 1 is a schematic perspective view of a metal extrusion press.
Figure 2:
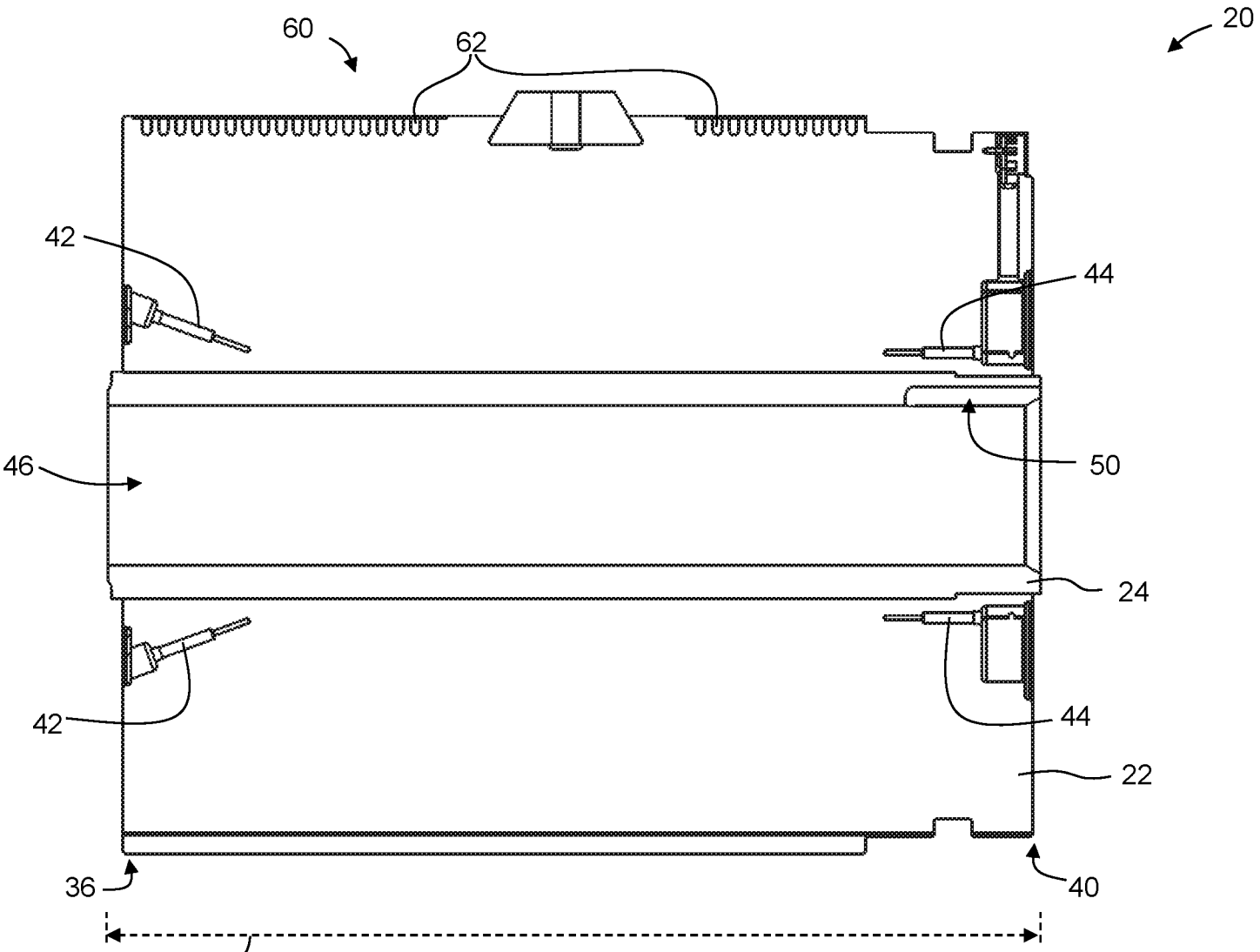
FIG. 2 is a sectional side view of a container forming part of the metal extrusion press of FIG. 1.

FIG. 1 is a simplified illustration of an extrusion press for use in metal extrusion. The extrusion press comprises a container 20 having an outer mantle 22 that surrounds an inner tubular liner 24. The container 20 serves as a temperature controlled enclosure for a billet 26 during extrusion of the billet. An extrusion ram 28 is positioned adjacent one end of the container 20. The end of the extrusion ram 28 abuts a dummy block 30, which in turn abuts the billet 26 allowing the billet to be advanced through the container 20. An extrusion die 32 is positioned adjacent a die end 36 of the container 20.

During operation, once the billet 26 is heated to a desired extrusion temperature (typically 800-900° F. for aluminum), it is delivered to the extrusion press. The extrusion ram 28 is then actuated to abut the dummy block 30, thereby to advance the billet 26 into the container and towards the extrusion die 32. Under the pressure exerted by the advancing extrusion ram 28 and dummy block 30, the billet 26 is extruded through the profile provided in the extrusion die 32 until all or most of the billet material is pushed out of the container 20, resulting in the extruded product 34.

The container 20 may be better seen in FIGS. 2 to 6. The container 20 is configured at the die end 36, and along the side sections thereof, in a manner known in the art to facilitate coupling of the container 20 to the extrusion press. The mantle 22 has an elongate shape and comprises an axial bore 37 accommodating the liner 24. In this embodiment, the mantle 22 and the liner 24 are shrunk-fit together.

The mantle 22 also comprises a plurality of longitudinal bores 38 extending from the ram end 40 of the mantle 22 to the die end 36 of the mantle 22, and surrounding the liner 24. Each longitudinal bore 38 is shaped to accommodate an elongate heating element, described further below, that can be energized to provide thermal energy to the mantle 22 in the vicinity of the liner 24 during use. The number of longitudinal bores 38 needed depends on the size of the container 20 and on the voltage used to energize the elongate heating elements. In this embodiment, the mantle 22 comprises sixteen (16) longitudinal bores 38.

The mantle 22 further comprises a plurality of bores 42 and 44 adjacent the liner 24 and extending partially into the length of the mantle 22. In this embodiment, the mantle 22 comprises two (2) bores 42 extending from the die end 36 approximately four (4) inches into the mantle 22, and two (2) bores 44 extending from the ram end 40 approximately four (4) inches into the mantle 22. Each bore 42 and 44 is shaped to accommodate a temperature sensor (not shown). The bores 42 and 44 are positioned in a manner so as to avoid intersecting any of the longitudinal bores 38 configured for accommodating the heating elements. In this embodiment, one (1) of the bores 42 is positioned above the liner 24 while the other bore 42 is positioned below the liner 24, and one (1) of the bores 44 is positioned above the liner 24 while the other bore 44 is positioned below the liner 24.

Figure 3:
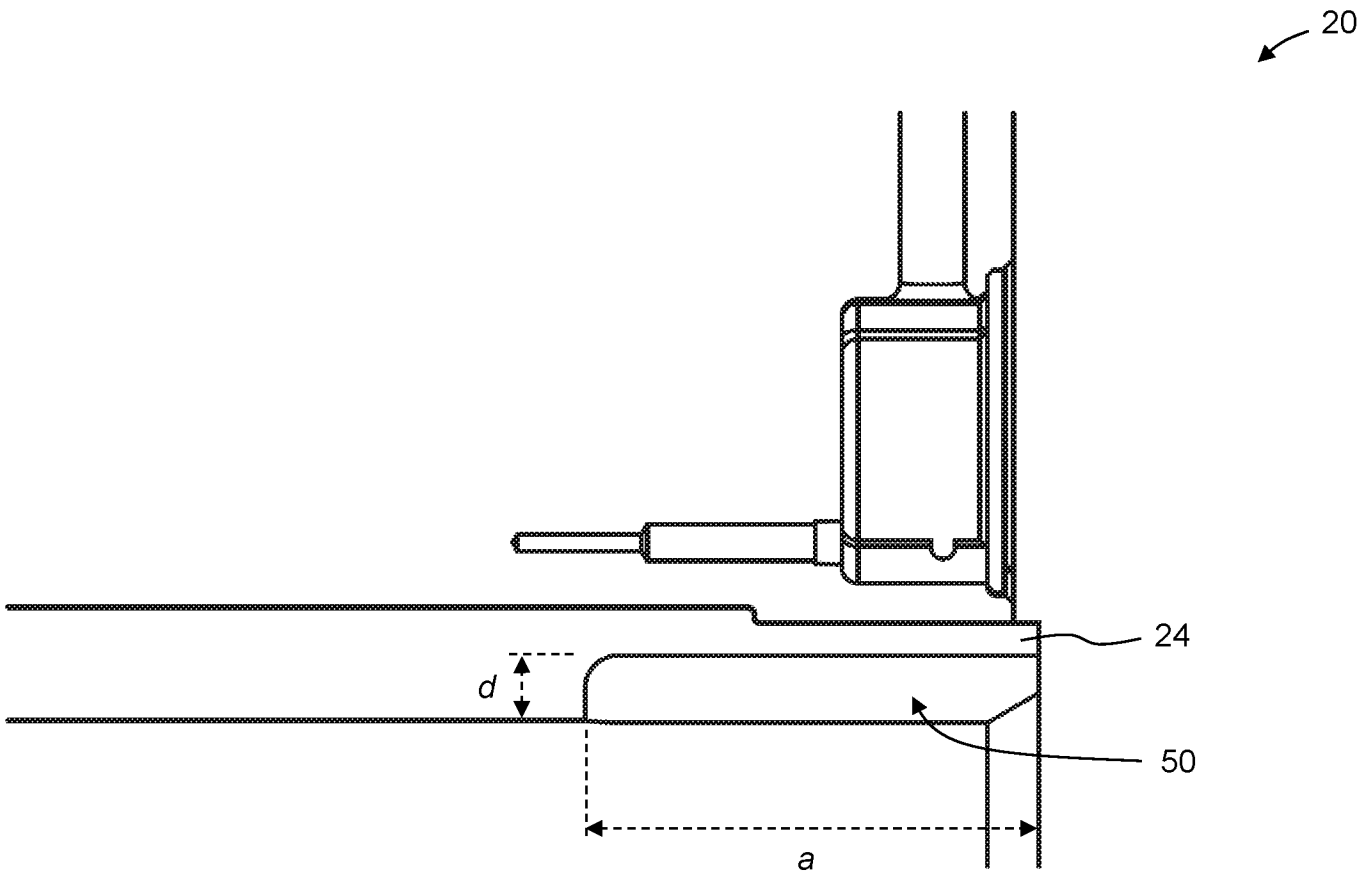
FIG. 3 is a fragmentary view of the container.
Figure 4:
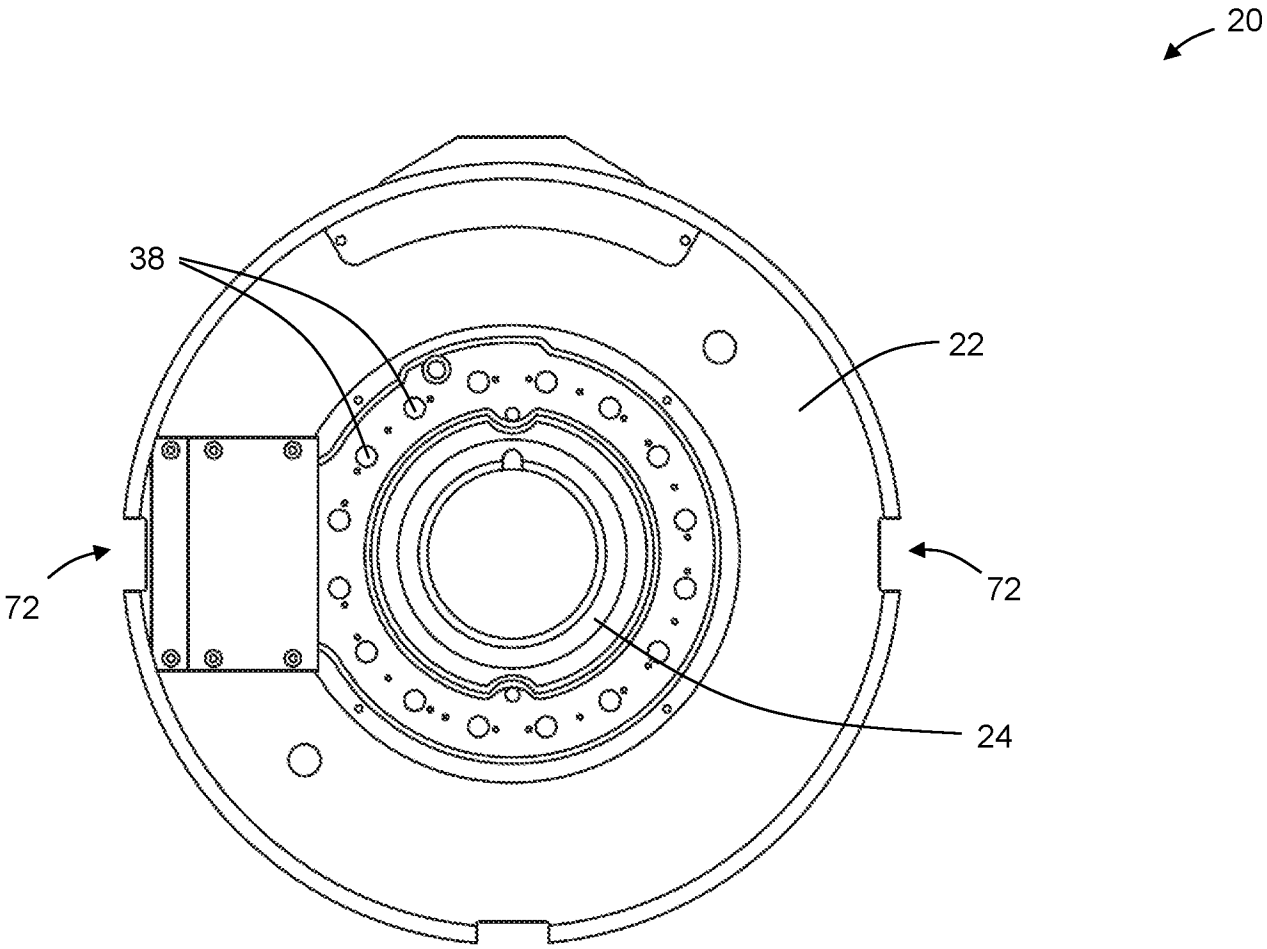
FIG. 4 is an end view of the container forming part of the metal extrusion press of FIG. 1.
Figure 5:
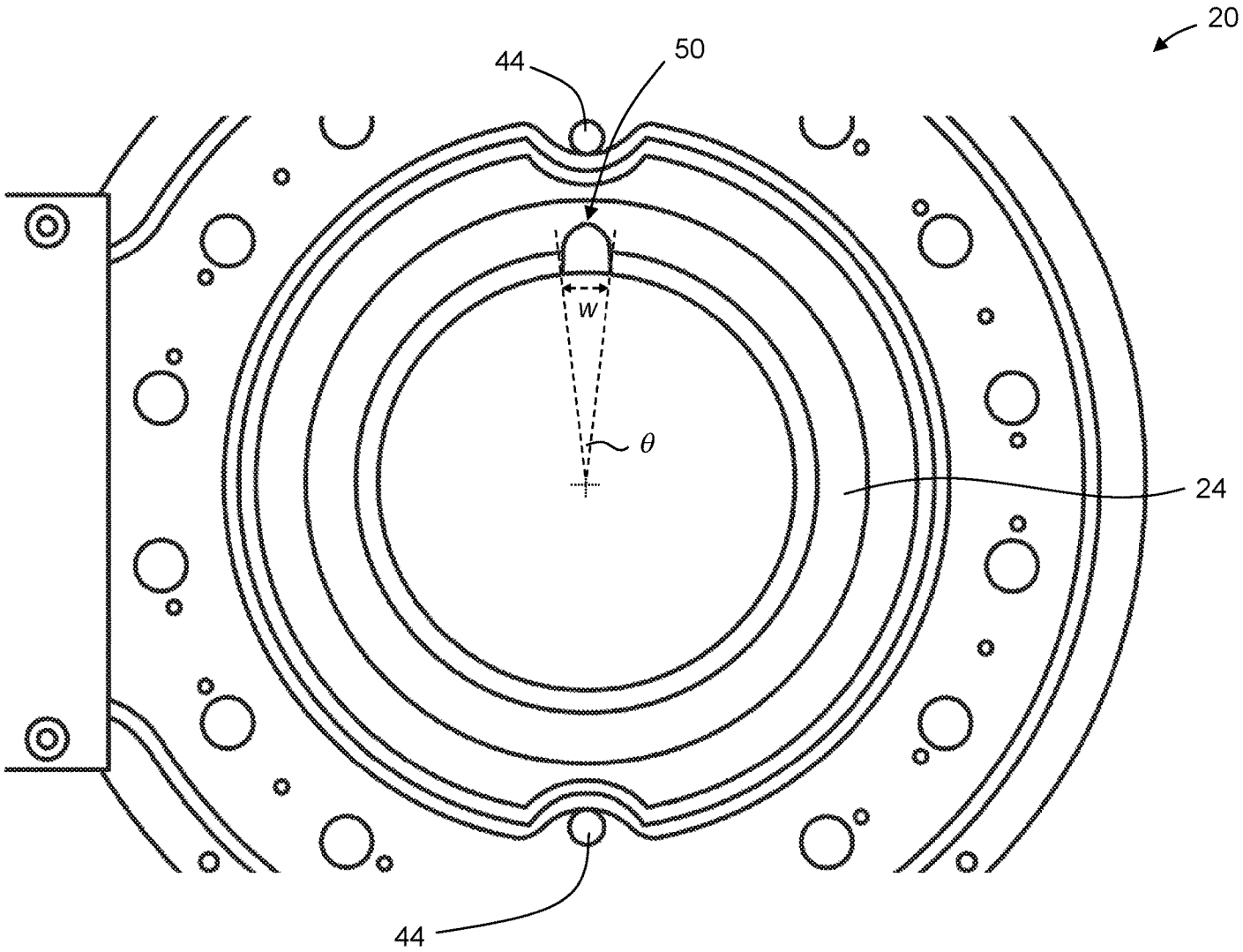
FIG. 5 is a fragmentary view of the container of FIG. 4.

The liner 24 comprises a billet receiving passage 46 that extends longitudinally therethrough and, in the embodiment shown, the passage 46 has a generally circular cross-sectional profile and a length L. The liner 24 further comprises a longitudinal slot 50 adjoining the passage 46, and which extends from the ram end of the liner 24 partially into its length in a direction parallel to the length L of the passage 46. The liner 24 is oriented such that the slot 50 is located at the top of the passage 46, which advantageously allows the slot to be in fluid communication with the air gap between the top of the billet 26 and the liner 24, during use. The slot 50 has a length a, and the slot 50 adjoins the passage 46 along its full length a, as shown in FIG. 3. The length a is selected such that the difference of the length L of the passage 46 and the length a of the slot 50, namely (L−a), is greater than the length of the billet 26. As will be understood, this ensures that the billet 26 is not adjacent slot 50 at the start of billet upset. The slot 50 does not extend around the full circumference of the passage 46, but rather has a width w that subtends an angle θ at the center of the passage 46, as shown in FIG. 5. In the example shown, the angle θ is about ten (10) degrees. Additionally, the slot 50 has a depth d that is less than the wall thickness of the liner 24, and in the example shown the depth d is about half the wall thickness of the liner 24.

Figure 6:
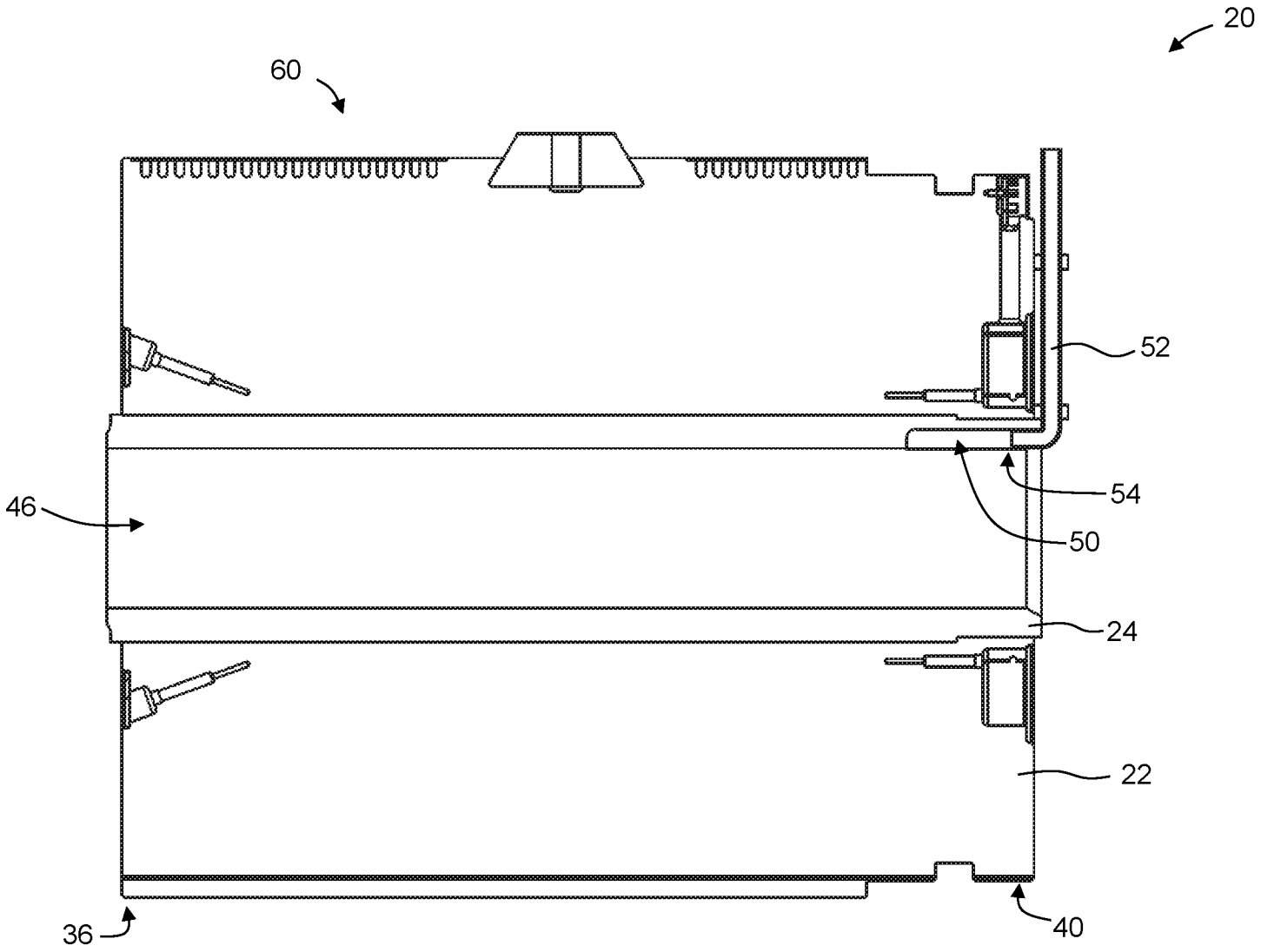
FIG. 6 is a sectional side view of the container of FIG. 2, showing a vacuum conduit attached thereto.

The liner 24 is configured to accommodate a portion of a vacuum conduit 52 in the slot 50. The vacuum conduit 52 is in the form of a tube or pipe, and has an aperture 54 that is positioned in the slot 50, inwardly from the ram end of the slot 50. In the example shown, the aperture 54 of the vacuum conduit 52 is positioned at about one-quarter of the length a of the slot 50, or at a distance of about 0.25 a, from the ram end of the slot 50. As shown in FIG. 6, the slot 50 and the vacuum conduit 52 are sized such that the vacuum conduit 52 does not protrude into the passage 46, or otherwise interfere with advancement of the billet through the passage 46.

The vacuum conduit 52 is in fluid communication with a vacuum source (not shown) that is configured to generate suction, also referred to as "negative pressure" or "vacuum". In this embodiment, the vacuum source is a vacuum pump. As will be understood, the vacuum conduit 52, in combination with the vacuum source, is configured to continuously apply suction to the passage 46, for removing gases from the passage 46 during operation.

The container 20 also comprises a heat sink that is in thermal communication with the mantle, and which is configured for cooling the container 20. In this embodiment, the heat sink comprises a fluid channel 60 adjacent an upper surface of the container 20 at the die end 36. The fluid channel 60 comprises a series of circumferentially-oriented, serpentine grooves 62 formed in an upper portion of the outer surface of the mantle 22, and a cover plate that is sized to cover the grooves 62. When the cover plate is installed so as to cover the grooves 62, the fluid channel 60 provides a generally enclosed, continuous channel through which fluid may flow to cool the container 20.

The fluid channel 60 is in fluid communication with a supply of pressurized fluid via an elongate fluid guide (not shown) accommodated within a longitudinal groove 72 that extends along a side of the mantle 22. The fluid guide comprises an input port (not shown) that is in fluid communication with a first end of the fluid channel 60, and that is also in fluid communication with a supply of pressurized fluid (not shown) via a supply line (not shown). In this embodiment, the fluid is air. A flow rate control apparatus (not shown) is connected to the supply of pressurized fluid and/or the supply line, and is configured to allow the flow rate of fluid entering the input port to be controlled by an operator. The fluid guide also comprises an output port that is in fluid communication with a second end (not shown) of the fluid channel 60, and which is also in fluid communication with an exhaust line (not shown). Fluid guides for use with extrusion containers have been described in U.S. Patent Application Publication No. 2014/0174143 to Robbins filed on Dec. 20, 2013, the entire contents of which are incorporated herein by reference.

Figure 7:
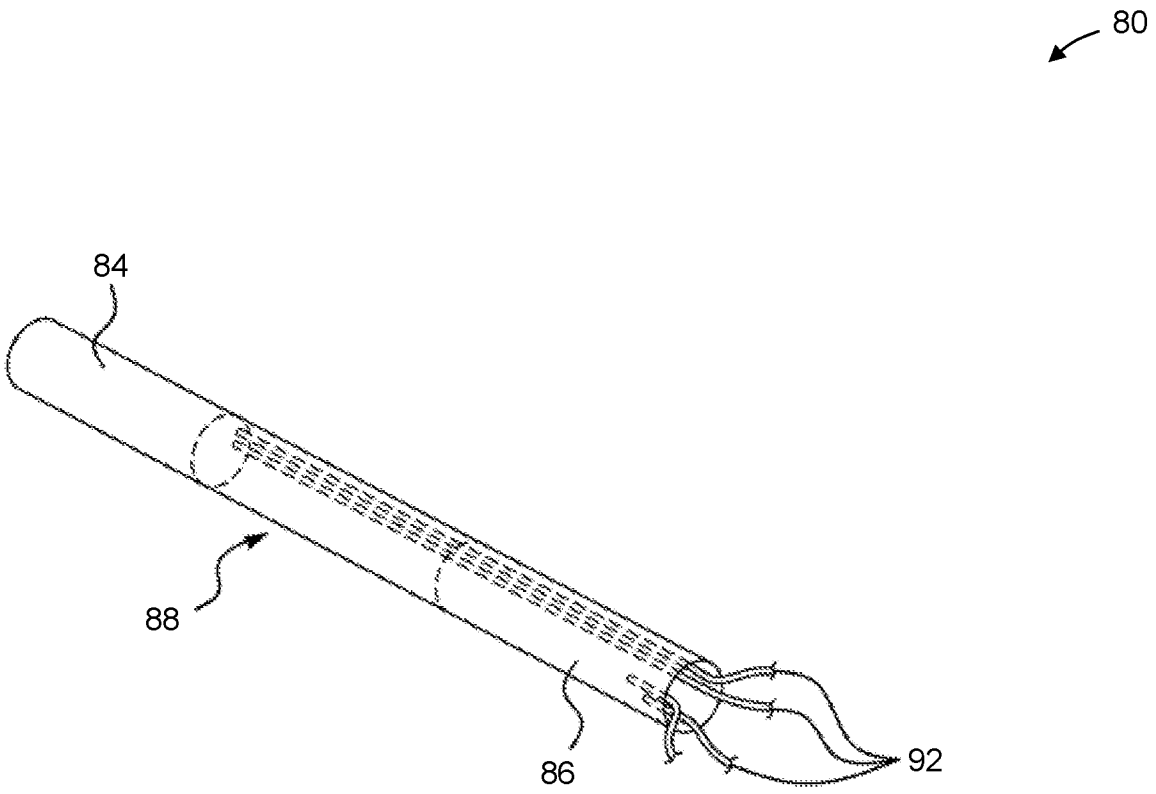
FIG. 7 is a perspective view of a heating element for use with the container.

FIG. 7 shows one of the elongate heating elements for use with the container 20, and which is generally indicated by reference numeral 80. Heating element 80 is a cartridge-type element. The regions of the container in greatest need of added temperature are generally the die end 36 and the ram end 40, referred to as a die end zone 82*a* and a ram end zone 82*b*, respectively. As such, each heating element 80 may be configured with segmented heating regions. In this embodiment, and as shown in FIG. 7, each heating element 80 is configured with a die end heating section 84 and a ram end heating section 86, which are separated by a central unheated section 88. To energize and control the heating elements, lead lines 92 feed to each heating section 84, 86. The lead lines connect to various bus lines (not shown), which in turn connect to a controller (not shown). The arrangement of the bus lines may take any suitable configuration, depending on the heating requirements of the container 20. In this embodiment, the bus lines are configured to selectively allow heating of the die end zone 82*a* and the ram end zone 82*b* of the container, or more preferably just portions thereof, as deemed necessary by the operator. In this embodiment, the arrangement of lead lines enables each of the heating elements 80 to be individually controllable, and also enables each of the heating sections 84, 86 within each heating element 80 to be individually controllable. For example, the operator may routinely identify temperature deficiencies in a lower die end zone 82*c* and a lower ram end zone 82*e*. The elongate heating elements 80 in the vicinity of the lower die end zone 82*c* and the lower ram end zone 82*e* are configured to be controlled by the operator to provide added temperature when required. Similarly, the elongate heating elements 80 in the vicinity of an upper die end zone 82*d* and an upper ram end zone 82*f* are configured to be controlled by the operator to provide reduced temperature when required. It will also be appreciated that the operator can selectively heat zones so as to maintain a preselected billet temperature profile. For example, the operator may choose a billet temperature profile in which the temperature of the billet progressively increases towards the die end, but with a constant temperature profile across the cross-sectional area of the billet. This configuration is generally referred to as a "tapered" profile. Having the ability to selectively heat zones where necessary enables the operator to tailor and maintain a preselected temperature profile, ensuring optimal productivity.

Each temperature sensor (not shown) is configured to monitor the temperature of the container during operation. The positioning of the two (2) bores 42 enables one (1) temperature sensor to be placed in the upper die end zone 82*d*, and one (1) temperature sensor to be placed in the lower die end zone 82*c*. Similarly, the positioning of the two (2) bores 44 enables one (1) temperature sensor to be placed in the upper ram end zone 82*f*, and one (1) temperature sensor to be placed in the lower ram end zone 82*e*. In this embodiment, the sensing elements are thermocouples. The temperature sensors feed into the controller, providing the operator with temperature data from which subsequent temperature adjustments can be made. As will be appreciated, the positioning of temperature sensors in the mantle 22 both above and below the liner 24 advantageously allows the vertical temperature profile across the liner 24 to be measured, and moreover allows any vertical temperature difference that arises during extrusion to be monitored by the operator.

During operation, at the beginning of an extrusion stroke, a heated billet 26 is delivered to the extrusion press. The extrusion ram 28 is then actuated to abut the dummy block 30, and thereby advances the billet 26 into the container 20 and towards the extrusion die 32. Under the pressure exerted by the advancing extrusion ram 28 and dummy block 30, the billet 26 is extruded through the profile provided in the extrusion die 32 until all or most of the billet material is pushed out of the container 20, resulting in the extruded product 34.

Figure 8A:
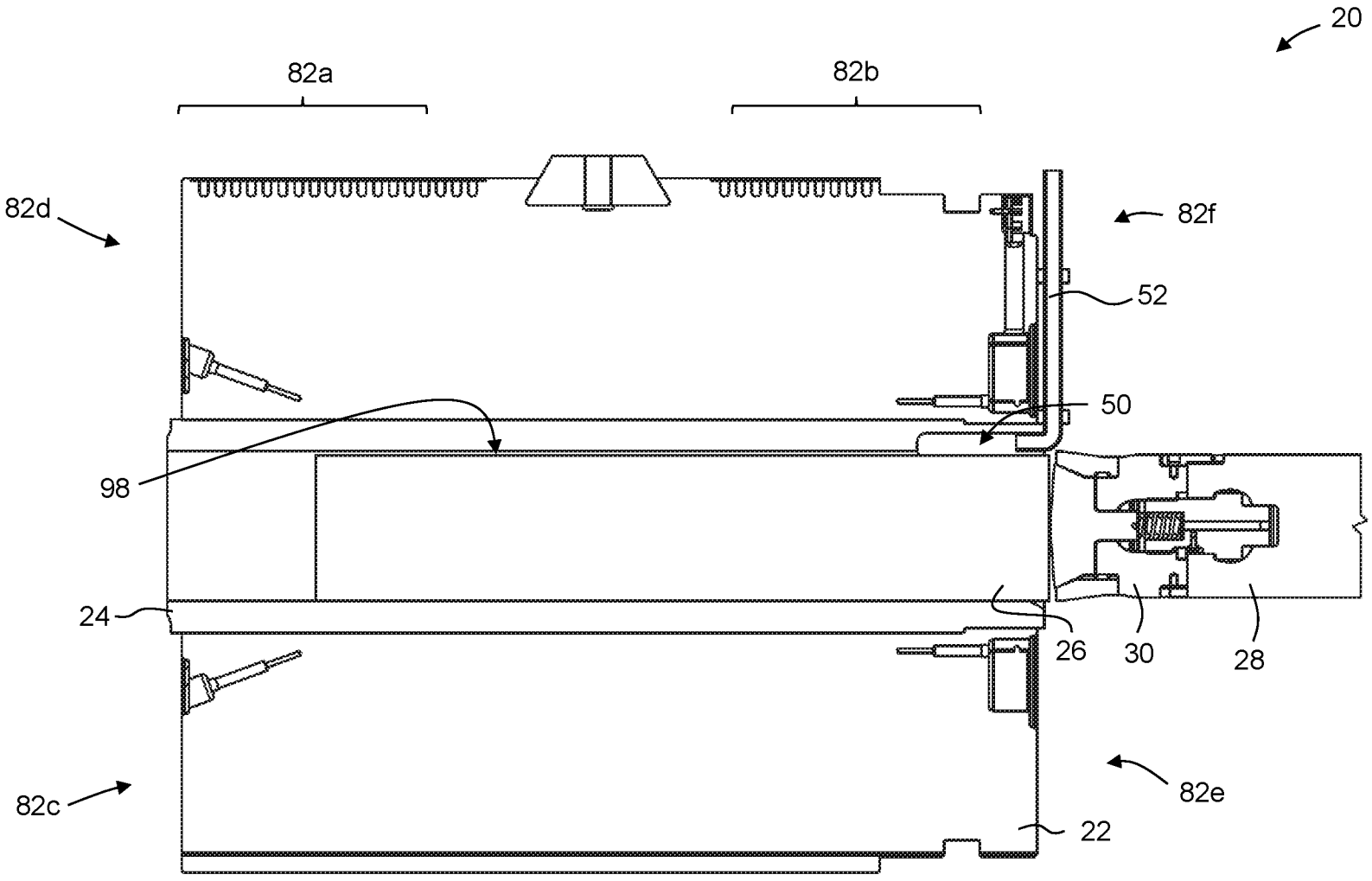
FIGS. 8*a* and 8*b* are sectional side views of the container, showing an extrusion ram and dummy block advancing a billet therethrough, during use.
Figure 8B:
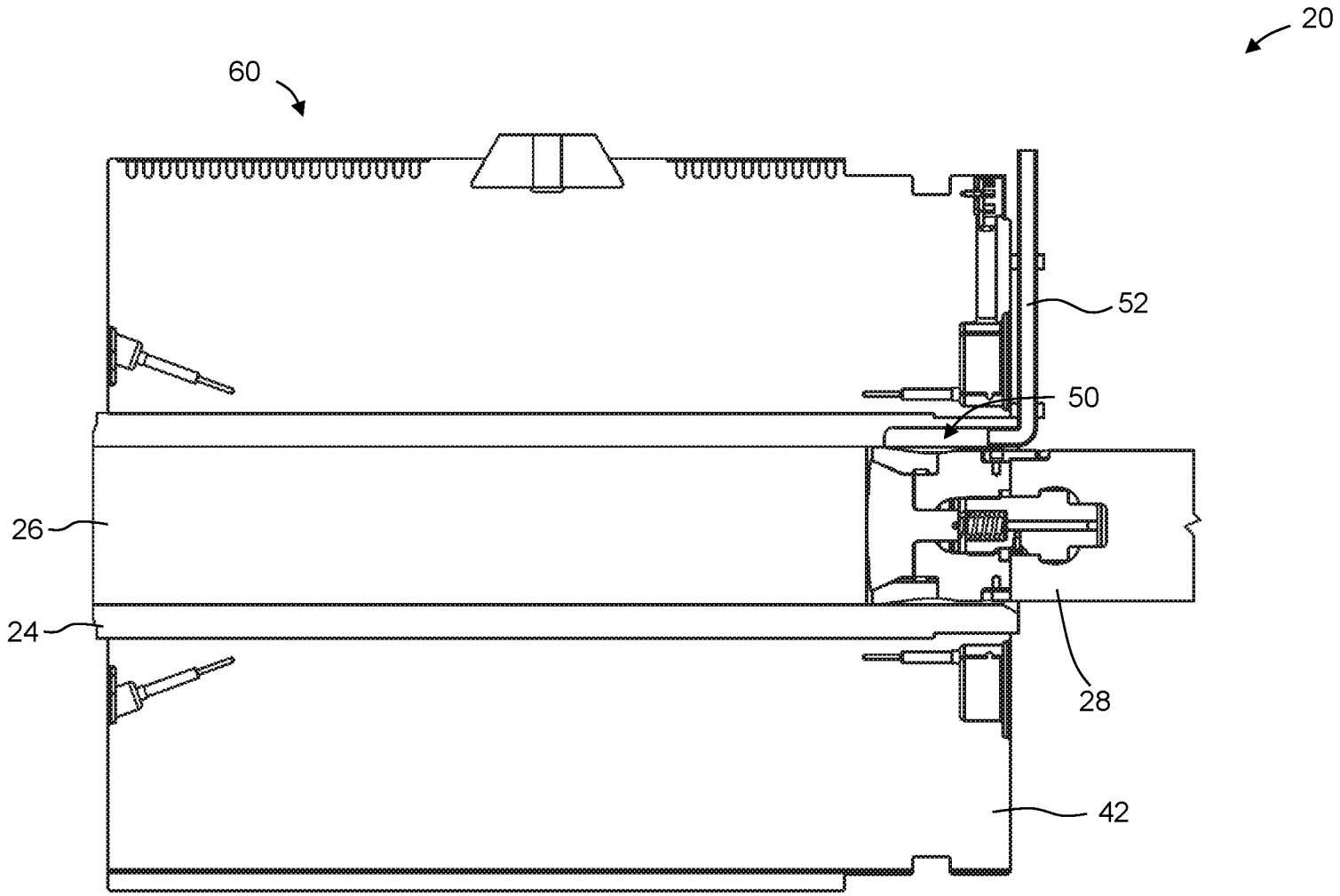

During the delivery and the advancement of the billet 26, suction generated by the vacuum source is continuously applied to the passage 46 of the liner 24 by the vacuum conduit 52 positioned in the slot 50. As a result, gases that accumulate in the passage 46, such as in the air gap 98 between the top of the billet 26 and the liner 24 as shown in FIG. 8*a* (and which exists until the start of billet upset, shown in FIG. 8*b*), are immediately removed via the aperture 54 of the vacuum conduit 52. These gases are thereby prevented from becoming incorporated into the billet 26 and otherwise forming voids or air bubbles in the extruded product 34.

Additionally, during operation, temperature data output from the temperature sensors is monitored by the operator. The position of the fluid channel 60 advantageously allows any temperature increase within the upper die end zone 82*d* to be reduced or eliminated by increasing the fluid flow rate therethrough. As will be understood, fluid provided by the pressurized fluid supply line enters the first end of the fluid channel 60 via the input port of the fluid guide. As the fluid travels along the length of fluid channel 60 to the second end (not shown), heat is transferred from the mantle 22 to the flowing fluid. The fluid exits from the fluid channel 60 via the output port and enters the exhaust line. As will be appreciated, the transfer of heat from the mantle 22 to the flowing fluid results in a temperature reduction within the upper die end zone 82*d* of the container 20.

The positioning of the elongate heating elements also advantageously allows any temperature increase within the upper die end zone 82*d* to be reduced or eliminated by reducing the thermal energy supplied by heating elements 80 positioned above the liner 24. Thus, as each of the heating elements are individually controllable, and as the flow rate of fluid through the fluid channel 60 is also controllable, the thermal profile across the liner 24 and within the container 20 can be accurately controlled. As will be understood, one or both of control of the fluid flow rate through the fluid channel 60, and control of the thermal energy supplied the heating elements, may be used to control the thermal profile across the liner 24 and within the container 20.

As will be appreciated, the configuration of the liner 24 with slot 50 adjoining the passage 46, with the vacuum conduit 52 accommodated in the slot 50, is simple, and does not require a pressure seal to be formed around any of the billet 26, the dummy block 30 or the extrusion ram 28, in order to remove gases from the passage 46. As will be understood, this feature advantageously enables the container 20 to be operated continuously, and without interruption or delay as would otherwise be required to establish a pressure seal for each billet. As a result, the throughput of the container 20 is higher than that of conventional extrusion containers having provisions for gas removal that require pressure seals to be established for each billet.

As will be appreciated, the relatively short length a of the slot 50, and the location of the slot 50 at the ram end of the liner 24, ensure that the billet 26 is not adjacent the slot 50 at the start of billet upset, when the stress applied to the inside of the liner 24 is greatest. As will be understood, this advantageously enables the liner 24 to have higher strength and to withstand greater extrusion forces during operation, as compared to prior art extrusion containers having transverse bores for gas removal located intermediate the ends of the liner. As will be understood, such transverse bores would otherwise serve as stress concentration points in the liner.

Although in the embodiment described above, the slot has a width that subtends an angle of about ten (10) degrees at the center of the passage, in other embodiments, the slot may alternatively have a width that subtends a different angle. For example, in other embodiments, the slot may alternatively have a width that subtends an angle of between about one (1) to about thirty (30) degrees at the center of the passage, or more preferably between about five (5) to about thirty (25) degrees at the center of the passage. Similarly, although in the embodiment described above, the slot has a depth that is about half the wall thickness of the liner, in other embodiments, the slot may alternatively have a depth that is between about 0.2 to about 0.8 the wall thickness of the liner.

Although in the embodiment described above, a portion of the vacuum conduit is accommodated in the slot, in other embodiments, no portion of the vacuum may alternatively be accommodated in the slot, but rather the vacuum conduit may simply be in fluid communication with the slot. For example, in one such embodiment, the aperture of the conduit may alternatively be positioned at the ram end of the slot, such that the vacuum conduit, in combination with the vacuum source, is configured to continuously apply suction to the passage, for removing gases from the passage during operation. In such an embodiment, the vacuum conduit is in fluid communication with the passage for removal of gases from the passage during extrusion.

Although in the embodiment described above, the fluid channel comprises circumferentially-oriented, serpentine grooves formed in the upper portion of the outer surface of the mantle, in other embodiments, the grooves may have other configurations. For example, in other embodiments, the fluid channel may alternatively comprise longitudinally-oriented, serpentine grooves formed in the upper portion of the outer surface of the mantle. Those skilled in the art will understand that still other groove configurations are possible. Additionally, the grooves need not necessarily be serpentine, and in other embodiments, the groove may alternatively have a non-serpentine configuration.

Although in the embodiment described above, the longitudinal bores for the elongate heating elements extend the length of the mantle, in other embodiments, the longitudinal bores for the elongate heating elements may alternatively extend only partially the length of the mantle. For example, in one embodiment, the longitudinal bores may alternatively extend from the ram end of the mantle to approximately one-half (0.5) inches from the die end of the mantle.

Although in the embodiment described above, the elongate heating elements are configured with die end heating sections and ram end heating sections, in other embodiments, the elongate heating elements may alternatively be configured with additional or fewer heating sections, and/or may alternatively be configured to heat along the entire length of the heating cartridge.

Although in the embodiment described above, the elongate heating elements in the vicinity of the lower die end zone and the lower ram end zone are described as being configured to be controlled by the operator to provide added temperature, it will be understood that these elongate heating elements are also configured to be controlled by the operator to provide reduced temperature. Similarly, although in the embodiment described above, the elongate heating elements in the vicinity of the upper die end zone and the upper ram end zone are described as being configured to be controlled by the operator to provide reduced temperature, it will be understood that these elongate heating elements are also configured to be controlled by the operator to provide added temperature.

Although in the embodiment described above, the mantle comprises four (4) bores for accommodating temperature sensors, in other embodiments, the mantle may alternatively comprise additional or fewer bores for accommodating temperature sensors.

Although in the embodiment described above, the bores for accommodating temperature sensors extend partially into the length of the mantle, in other embodiments, the bores may alternatively extend the full length of the mantle. In related embodiments, the temperature sensors may alternatively be "cartridge" type temperature sensors, and may alternatively comprise a plurality of temperature sensing elements positioned along their length.

Although in the embodiment described above, the fluid is air, in other embodiments, one or more other suitable fluids may alternatively be used. For example, in other embodiments, the fluid may be any of nitrogen and helium. In other embodiments, the fluid may be cooled by a cooling apparatus prior to entering the fluid channel.

Although in the embodiment described above, the fluid channel comprises a groove formed in an upper portion of the outer surface of the mantle, in other embodiments, other configurations in which the fluid channel is in thermal communication with the mantle are possible. For example, in other embodiments, the fluid channel may alternatively comprise a groove formed in one or more other portions of the outer surface of the mantle. In still other embodiments, the fluid channel may alternatively comprise a fluid channel passing through the interior of the mantle.

Although embodiments have been described above with reference to the accompanying drawings, those of skill in the art will appreciate that variations and modifications may be made without departing from the scope thereof as defined by the appended claims.

What is claimed is:

1. A container for use in a metal extrusion press, the container comprising:

a mantle having an elongate body comprising an axial bore;

an elongate liner accommodated within the axial bore, the liner comprising:

a longitudinally extending passage through which a billet is advanced, and an elongate slot adjoining the passage, the slot extending from a longitudinal end of the liner and having a width that is less than a circumference of the passage; and a vacuum conduit in fluid communication with the passage for removal of gases from the passage during extrusion, wherein the vacuum conduit is accommodated within the slot.

2. The container of claim 1, wherein the liner has a length, and wherein the slot extends partially the length of the liner.

3. The container of claim 1, wherein the slot extends in a direction parallel to a longitudinal axis of the passage.

4. The container of claim 1, wherein the slot adjoins the passage along a full length of the slot.

5. The container of claim 1, wherein the slot is located at a top of the passage.

6. The container of claim 1, wherein the slot has a width that extends around only a portion of the circumference of the passage.

7. The container of claim 6, wherein the width of the slot subtends an angle at a center of the passage.

8. The container of claim 7, wherein the angle is between about 5 degrees to about 25 degrees.

9. The container of claim 1, wherein the slot has a depth that is less than a wall thickness of the liner.

10. The container of claim 1, wherein the vacuum conduit is in fluid communication with a vacuum source.

11. The container of claim 10, wherein the vacuum source is a vacuum pump.

12. The container of claim 1, wherein the mantle further comprises a plurality of longitudinal bores, each of the bores accommodating a respective heating element.

13. The container of claim 1, wherein the mantle is configured for connecting to an extrusion press.

14. The container of claim 1, wherein a maximum width of the slot along the full length of the slot is less than the circumference of the passage.

15. A method of operating a metal extrusion press, the extrusion press having an extrusion container and an extrusion die, the method comprising:

delivering a heated billet to the container;

advancing the billet into the container and through the extrusion die using an extrusion ram, the container having an elongate liner comprising a longitudinally extending passage through which the billet is advanced; and applying suction to the container during said delivering and said advancing, wherein said suction is applied via a vacuum conduit accommodated within a slot adjoining the liner, the slot extending from a longitudinal end of the liner and having a width that is less than a circumference of the longitudinally extending passage.

16. The method of claim 15, wherein said suction is continuously applied without forming a seal around the billet.

17. The method of claim 15, wherein a maximum width of the slot along the full length of the slot is less than the circumference of the passage.

* * * * *